US008893585B2

(12) United States Patent
Descombes et al.

(10) Patent No.: US 8,893,585 B2
(45) Date of Patent: Nov. 25, 2014

(54) HAND-OPERATED STRIKING TOOL ENABLING VIBRATIONS TO BE REDUCED, AND METHOD FOR MANUFACTURING

(75) Inventors: Frederic Descombes, Saint Helene du Lac (FR); Didier Lugrin, La Ravoire (FR); Fabrice Pepin, Coise (FR)

(73) Assignee: Fiskars France SAS, Villebon sur Yvette (FR)

( * ) Notice: Subject to any disclaimer, the term of this patent is extended or adjusted under 35 U.S.C. 154(b) by 349 days.

(21) Appl. No.: 13/305,191

(22) Filed: Nov. 28, 2011

(65) Prior Publication Data

US 2012/0152066 A1 Jun. 21, 2012

(30) Foreign Application Priority Data

Dec. 21, 2010 (FR) ..... 10 05001

(51) Int. Cl.

| | |
|---|---|
| ***B25D 1/12*** | (2006.01) |
| ***B25D 1/00*** | (2006.01) |
| ***B25G 1/01*** | (2006.01) |
| ***B25D 1/04*** | (2006.01) |

(52) U.S. Cl.

CPC ..... *B25G 1/01* (2013.01)
USPC ..... 81/22; 81/20; 81/489; 7/143

(58) Field of Classification Search

USPC ..... 81/22, 20, 489; 7/143
See application file for complete search history.

(56) References Cited

U.S. PATENT DOCUMENTS

| | | | | |
|---|---|---|---|---|
| 2,603,260 | A * | 7/1952 | Floren | 81/22 |
| 3,770,033 | A * | 11/1973 | Gavillet et al. | 81/22 |
| 4,404,708 | A * | 9/1983 | Winter | 16/110.1 |
| 4,753,137 | A * | 6/1988 | Kennedy | 81/22 |
| 6,619,408 | B1 * | 9/2003 | Lai | 173/90 |
| 7,178,428 | B2 * | 2/2007 | Schroder | 81/20 |
| 2005/0193876 | A1 | 9/2005 | Broyles | |
| 2009/0000039 | A1 * | 1/2009 | St. John et al. | 7/138 |

FOREIGN PATENT DOCUMENTS

| | | |
|---|---|---|
| EP | 1 283 092 A1 | 2/2003 |
| WO | WO 00/09296 A1 | 2/2000 |
| WO | WO 01/14106 AI | 3/2001 |

* cited by examiner

*Primary Examiner* — Bryan R Muller
(74) *Attorney, Agent, or Firm* — Oliff PLC

(57) ABSTRACT

This tool, which is in particular a hammer, comprises a gripping handle, a striking head, and an intermediate shaft extending the handle and supporting the head, whereas the handle comprises a tube in which the shaft partially extends, this tube and this shaft being made from a rigid material presenting a first hardness.

This shaft has a radial area bearing against the tube, with interposition of a link part, for absorbing vibrations, made from flexible material presenting a second hardness that is much lower than the first hardness, and a free terminal area, not covered by the link part, radially separated from the walls of the tube so as to be able to vibrate freely in an internal volume of the tube.

18 Claims, 4 Drawing Sheets

HAND-OPERATED STRIKING TOOL ENABLING VIBRATIONS TO BE REDUCED, AND METHOD FOR MANUFACTURING

BACKGROUND OF THE INVENTION

The invention relates to a hand-operated striking tool, i.e. able to be used without a motor. Within the scope of the invention, such a tool is in particular but not exclusively a hammer, a club, a sledge hammer or a mallet.

STATE OF THE ART

In usual manner, a striking tool of hammer type is composed of a handle enabling it to be gripped by the user, to which a striking head is joined. It can be conceived that, when repeated striking actions are performed, such a tool generates substantial vibrations which are transmitted directly to the operator. This is accompanied by musculo-skeletal troubles, such as pains at the level of the carpal tunnel or a loss of sensation at the finger-tips. These ailments can lead to the operator having to temporarily stop working or can cause lasting damage to his physical integrity.

In order to remedy this problem of the occurrence of vibrations, the STANLEY company has proposed a hammer forged in a single part. Such a hammer defines a shaft joining the gripping handle to the head, which shaft is coated with a material absorbing vibrations. This same company has proposed a tuning-fork system, provided at the end of the handle, enabling the vibrations to be concentrated.

It has however been observed that the solutions presented above do not provide a satisfactory solution to the vibration problem occurring when striking tools are used.

OBJECT OF THE INVENTION

Under these conditions, the object of the invention is to propose a striking tool which enables vibrations to be significantly reduced compared with tools of the state of the art, while at the same time presenting a satisfactory efficiency and a reasonable cost.

The tool according to the invention is remarkable in that it further comprises an intermediate shaft extending the handle and supporting the head, and in that the handle comprises a tube in which the shaft partially extends, this shaft and this tube being made from a first and second rigid materials presenting a first hardness range, this shaft having a radial bearing area bearing against the tube, with interposition of a link part, for absorbing the vibrations, made from a flexible material presenting a second hardness considerably lower than the first hardness, and a free terminal area not covered by the link part, radially separated from the walls of the tube so as to be able to vibrate freely in an internal volume of the tube.

Interposition of the flexible link part between the shaft and tube, both of which are rigid, first enables the vibration bridge to be broken. In addition, as the terminal region of the tip is free inside the tube, this enables the shaft to vibrate in an air zone set aside for this purpose, thereby contributing to isolating the vibrations. Finally, the rigidity of the shaft tends to increase the frequency of the vibrations, in part above the threshold perceived by human beings, so that the global feeling experienced by the user is improved.

Other technical features can be used either alone or in combination:

- the rigid materials present a hardness comprised between 30 and 60 Rockwell C, the first material forming the shaft in particular presenting a hardness comprised between 42 and 50 Rockwell C, whereas the second material forming the tube in particular presents a hardness comprised between 38 and 42 Rockwell C, these rigid materials being in particular made from metal, in particular a steel
- the flexible material presents a hardness comprised between 60 and 80 Shore D, in particular between 65 and 75 Shore D, this flexible material being in particular a plastic material, in particular polypropylene
- the walls, facing the bearing area on the one hand and the link part and the tube on the other hand, are in tight contact
- a functional clearance exists between the walls facing the bearing area and the link part at the level of at least a front surface of the tool
- at the level of at least a front surface of the tool, the link part is slotted or presents a strip of soft material having a hardness comprised between 0 and 50 Shore A
- the link part comprises a sheath surrounding said bearing area, and a neck designed to be axially inserted between the handle and the shaft
- the handle, link part and shaft are mutually secured by a fixing part extending in the direction of a vibration node of the tool.

The invention also relates to a method for manufacturing a tool as above, characterized in that the head and shaft are mutually secured, the link part is then fitted in place on the shaft in the final position which the latter are to take, and finally the shaft and link part are engaged inside the tube.

According to an advantageous feature, the head and shaft are secured by crimping a barrel of the shaft in a housing of the head, and a hardening and tempering operation is previously performed on the whole of the shaft with the exception of the barrel.

BRIEF DESCRIPTION OF THE DRAWINGS

Other advantages and features will become more clearly apparent from the following description of a particular embodiment of the invention, given for non-restrictive example purposes only and represented in the appended drawings in which.

DESCRIPTION OF A PREFERRED EMBODIMENT OF THE INVENTION

Figure 1:
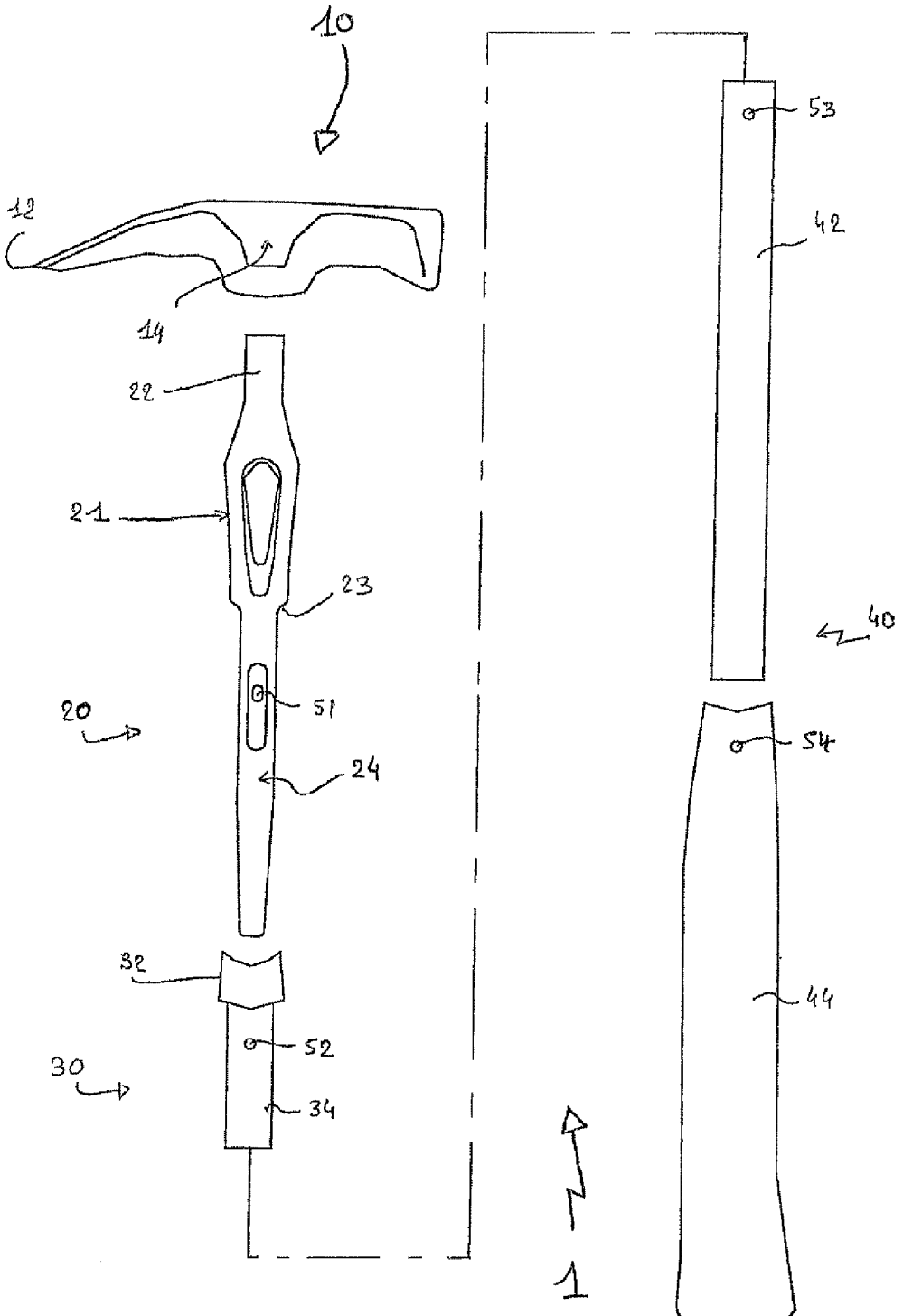
FIG. 1 is a front view illustrating the different elements constituting a tool according to the invention, in exploded manner.

The different figures represent an example of a striking tool according to the invention, which is in this instance a hammer. This tool 1 is essentially composed of a striking head 10, an intermediate shaft 20, a joining part 30 designed to dampen vibrations, and a gripping handle 40.

Head 10 is of conventional structure, suitable for the required function of the hammer. In the example, it is of elongate shape, being provided with prongs 12 to pull nails or tacks out. A housing 14 enabling the shaft to be inserted is further drilled out in this head.

Shaft 20, which extends in the extension of handle 40, joins the latter to head 10. It is made from a first material called rigid material, which is in particular made from metal, in particular from steel. This shaft 20 has a body 21, terminated by a barrel 22 designed to be crimped inside the above-mentioned housing 14. Opposite this barrel, the body is extended, via a rim 23, by a tip 24 designed to enter into a tube belonging to the handle. This first rigid material forming the shaft has a first hardness range, comprised for indicative purposes between 42 and 50 RCH (Rockwell C Hardness, hereafter called Rockwell C). This value concerns the whole of the shaft except for its barrel, which is subjected to a different heat treatment as will be seen further on.

Link part 30 is made from a material called flexible material, which is in particular a plastic material, in particular polypropylene. This material has a second hardness range comprised for indicative purposes between 60 and 80 Shore D. This link part 30 first of all comprises a neck 32 designed to come up against the stop formed by shaft 20, and a sheath 34 designed to extend at the periphery of a part of the tip 24 of this shaft.

Finally, handle 40 firstly comprises an inner tube 42 formed by a second rigid material identical or similar to the material forming shaft 20. This second rigid material presents a hardness comprised for indicative purposes between 38 and 42 Rockwell C. Tube 42 is surrounded by a sleeve 44 formed from any suitable material enabling a satisfactory grip to be achieved. It should be noted that different holes 51 to 54 are drilled in the shaft, link part, tube and sleeve for passage of a fixing member.

In order to assemble the tool, shaft 20 is first of all crimped onto the head. In advantageous manner, a hardening and tempering operation is previously performed on the shaft to give the latter an increased resistance to flexing of the tool. It is however preferred for barrel 22 not to be subjected to this hardening in order to facilitate the crimping stage.

Link part 30 is then fitted in place on shaft 20 so that neck 32 comes up against the stop formed by rim 23. The assembly formed by head 10, shaft 20 and link part 30 is then engaged inside tube 42. Finally a suitable securing means 60, for example of nut-and-bolt type or similar, is fitted through the different apertures 51 to 54. When this assembly has been completed, neck 32 is axially inserted between rim 23 and the facing end of sleeve 44. Furthermore, as will be described in detail in the following, tip 24 penetrates into the internal volume of tube 42, with partial interposition of sheath 34.

Figure 2:
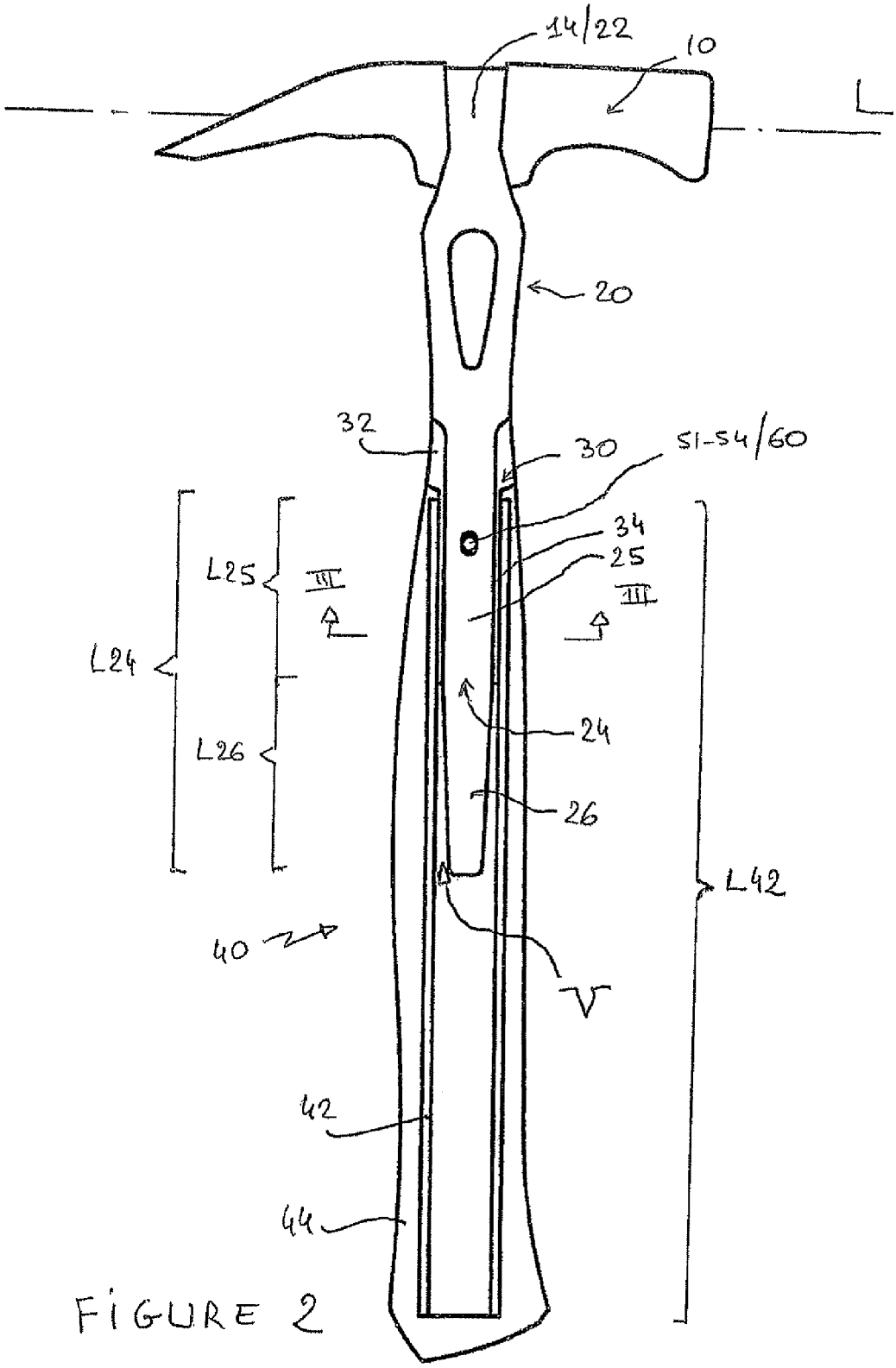
FIG. 2 is a longitudinal cross-sectional view illustrating a tool according to the invention, once assembled.

With reference in particular to FIG. 2, the length of tube 42 is noted L42, and the depth of penetration of tip 24 into tube 20 is noted L24. Furthermore, the area called pressing area of tip 24 covered by the sheath, pressing radially against the tube, is noted 25, and the area called free area of this tip, which is not covered, is noted 26. Finally the respective lengths of these two areas defined in this way are noted L25 and L26.

Different numerical values are given hereafter in non-restrictive manner:

- the depth of penetration L24 is comprised between 50 and 100 mm, in particular between 60 and 70 mm. A penetration of substantial length of the shaft into the tube is advantageous as it enables the striking force to be extended down to the end of the handle.
- the ratio L24/L42 between the depth of penetration and the length of the tube is comprised between 0.22 and 0.45, in particular between 0.26 and 0.32, in particular close to 0.28.
- the length L25 of the radial bearing area is greater than 40 mm.
- the length L26 of the free area is greater than 15 mm.
- the ratio L26/L24 between the length of the bearing area 25 and the depth of penetration is comprised between 0.63 and 0.79, in particular between 0.71 and 0.78, in particular close to 0.75.

Figure 3:
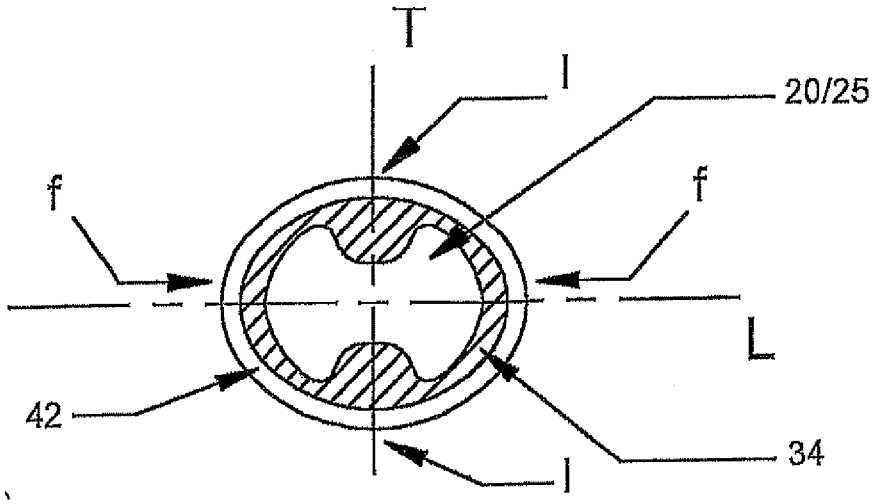
FIG. 3 is a longitudinal cross-sectional view along the line III-III in FIG. 2, FIGS. 4 and 5 are cross-sectional views, similar to FIG. 3, illustrating two alternative embodiments of the invention.

Reference is now made to FIG. 3 which is a cross-section of the tool at the level of bearing area 25. The longitudinal and transverse axes, which correspond to the orientation of the head, are respectively noted L and T. It is conceived that the greater part of the striking forces are exerted along the longitudinal axis. The front surfaces of the tool, with reference to the axis L, are called f, and the lateral surfaces are called l.

Figure 4:
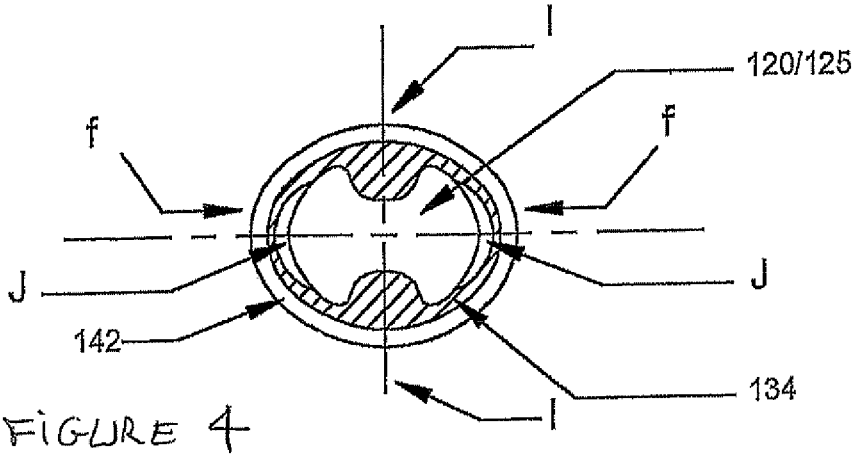

In the illustrated example, the surfaces facing bearing area 25 of shaft 20 and sheath 34 on the one hand, and facing the sheath and tube 42 on the other hand, are in tight contact. In other words, there is no functional difference between these different mechanical parts. However, as an alternative embodiment represented in FIG. 4, it can be provided to arrange at least a functional clearance between bearing area 125 of shaft 120 and sheath 134. In preferred manner, this clearance J is present only at the level of at least one front surface f, but on the other hand not at the level of the lateral surfaces l, nor between sheath 134 and tube 142.

Figure 5:
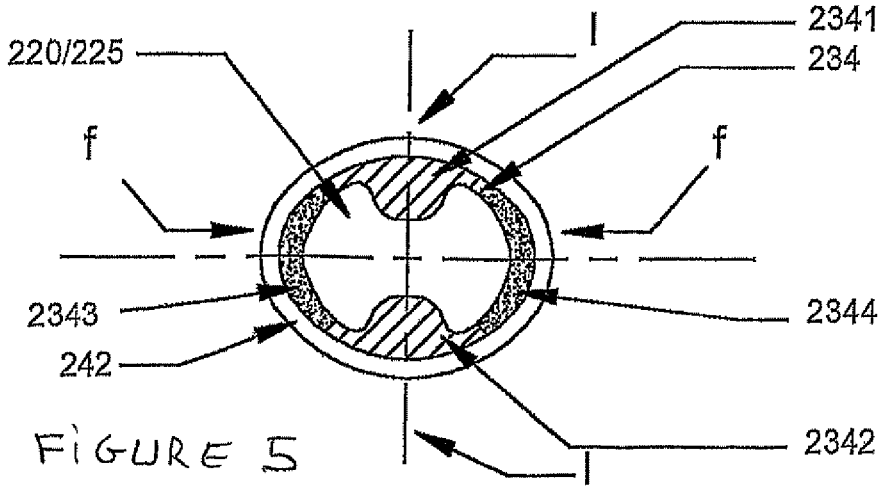

According to an additional variant represented in FIG. 5, sheath 234, inserted between bearing area 225 of shaft 220 and tube 242, is formed by four strips 2341 to 2344. On the side where lateral surfaces l are located, the diametrically opposed strips 2341 and 2342 are made from a flexible material, as defined in the foregoing. The other two strips 2343 and 2344, placed on front surfaces f, are on the other hand made from a soft material. The latter, which has a third hardness range comprised for indicative purposes between 0 and 50 Shore A, is for example an elastomer.

Finally, in another alternative embodiment that is not represented, the sheath is slotted, i.e. the two front strips 2343 and 2344 of soft material are eliminated. In this case, the facing surfaces of the shaft and of the sheath are separated by two empty spaces placed in frontal manner.

With reference in particular to FIGS. 2 to 5, when the tool is used, the presence of flexible sheath 34, 134, 234 between shaft 20, 120, 220 and tube 42, 142, 242, both of which are rigid, contributes to breaking the vibration bridge. Furthermore, in its terminal free area 26, the shaft is able to vibrate in an air volume reserved for this purpose. This volume, noted V in FIG. 2, is delineated by a part of the tube. It should finally be noted that the presence of sleeve 44 made from elastomer material is advantageous, as it contributes to damping high-frequency vibrations.

Figure 6:
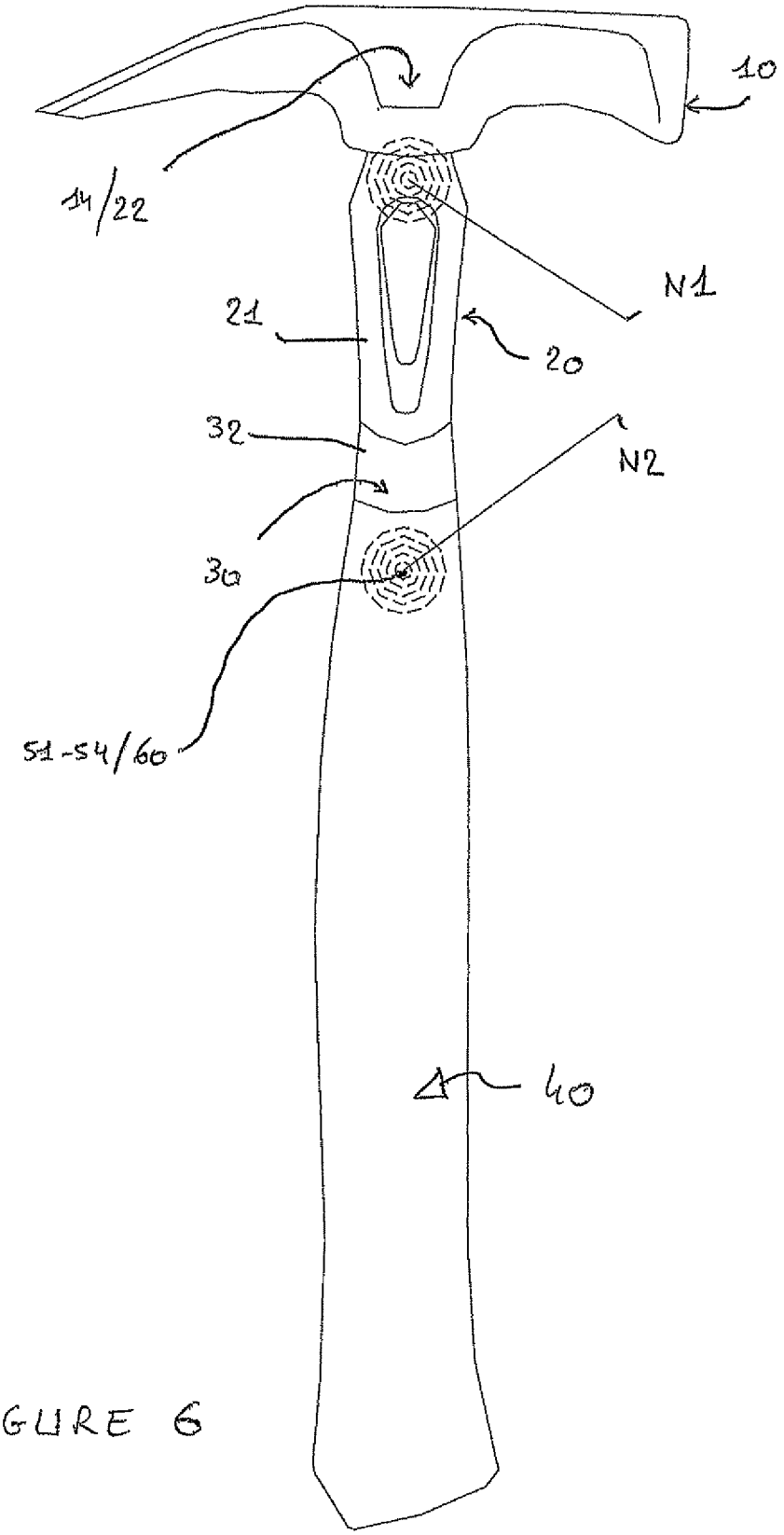
FIG. 6 is a front view more particularly illustrating the vibration nodes to which a tool according to the invention is subjected in service.

FIG. 6 illustrates the vibration nodes N1 and N2 associated with the tool during use of the latter. By nature, the vibration modes of a striking tool make the latter oscillate around two substantially immobile axes which form the above-mentioned nodes. According to an advantageous feature of the invention, apertures 51 to 54 are arranged at the location of the bottom node N2, i.e. the one that is distant from the head. Securing means 60 then also extend along this node N2. This enables the handle to be disassembled from the shaft, thereby contributing to reducing the intensity of the vibrations globally perceived by the user.

According to an advantageous embodiment which is not represented, it is provided to seal off the bottom part of tube 42 by means of a plastic plug. This firstly prevents the polypropylene which constitutes sleeve 44 from penetrating into the tube when implementation is performed by injection. It can further be provided to give this plug any suitable shape in order to reduce the vibrations in the tube. As a non-restrictive example, this plug can in particular be solid or of annular shape, or be cross-headed with a slit in the middle.

The invention claimed is:

1. A hammer-type, hand-operated striking tool, comprising:

a gripping handle;

a striking head;

an intermediate shaft extending through the handle and supporting the head; and an intermediate link part, the handle comprising a tube in which the shaft partially extends, the shaft and the tube being respectively made from first and second rigid materials each presenting a hardness within a first hardness range, the shaft having a radial area that bears against the tube via the link part, the link part being positioned between the tube and the shaft and being made from a flexible material presenting a second hardness lower than the first hardness range so as to absorb vibrations, the shaft having a free terminal area that is not covered by the link part, that spans from the link part to a terminal end of the shaft, and that is radially separated from the tube so as to be able to vibrate freely in an internal volume of the tube, and the tool being configured so that an air volume fills the entire space between the free terminal area and the tube.

2. The tool according to claim 1, wherein the first and second rigid materials present a hardness of between 30and 60Rockwell C.

3. The tool according to claim 1, wherein the flexible material presents a hardness of between 60and 80Shore D.

4. The tool according to claim 1, wherein (1) the bearing area of the shaft and the link part and (2) the link part and the tube are in tight contact.

5. The tool according to claim 1, wherein a functional clearance exists between the bearing area of the shaft and the link part at the level of at least a front surface of the tool.

6. The tool according to claim 1, wherein, at the level of at least a front surface of the tool, the link part is slotted or presents a strip of soft material having a hardness of between 0and 50Shore A.

7. The tool according to claim 1, wherein the link part comprises a sheath surrounding the bearing area of the shaft, and a neck designed to be axially inserted between the handle and the shaft.

8. The tool according to claim 1, wherein the handle, link part and shaft are mutually secured by a fixing part extending in the direction of a vibration node of the tool.

9. The tool according to claim 2, wherein:

the first rigid material forming the shaft presents a hardness of between 42and 50Rockwell C; and the second rigid material forming the shaft presents a hardness of between 38and 42Rockwell C.

10. The tool according to claim 9, wherein the first and second rigid materials are made from metal.

11. The tool according to claim 10, wherein the first and second rigid materials are made from steel.

12. The tool according to claim 3, wherein the flexible material presents a hardness of between 65and 75Shore D.

13. The tool according to claim 12, wherein the flexible material is a plastic material.

14. The tool according to claim 13, wherein the flexible material is polypropylene.

15. The tool according to claim 1, wherein a ratio between (i) the depth of penetration of the shaft into the tube and (ii) the length of the tube is between 0.22and 0.45.

16. A method for manufacturing a hammer-type, hand-operated striking tool, the method comprising: providing the tool comprising:

a gripping handle;

a striking head;

an intermediate shaft extending through the handle and supporting the head; and an intermediate link part, the handle comprising a tube in which the shaft partially extends, the shaft and the tube being respectively made from first and second rigid materials each presenting a hardness within a first hardness range, the shaft having a radial area that bears against the tube via the link part, the link part being positioned between the tube and the shaft and being made from a flexible material presenting a second hardness lower than the first hardness range so as to absorb vibrations, the shaft having a free terminal area that is not covered by the link part, that spans from the link part to a terminal end of the shaft, and that is radially separated from the tube so as to be able to vibrate freely in an internal volume of the tube, and the tool being configured so that an air volume fills the entire space between the free terminal area and the tube, and the method comprising the steps of:

mutually securing the head and the shaft;

fitting the link part in place on the shaft in the final position that the link part and the shaft are to take; and engaging the shaft and the link part inside the tube.

17. The method according to the claim 16, wherein:

the head and the shaft are secured by crimping a barrel of the shaft in a housing of the head, and a hardening and tempering operation is previously performed on the whole of the shaft with the exception of the barrel.

18. A hammer-type, hand-operated striking tool, comprising:

a gripping handle;

a striking head;

an intermediate shaft extending through the handle and supporting the head; and an intermediate link part, the handle comprising a tube in which the shaft partially extends, the shaft and the tube being respectively made from first and second rigid materials each presenting a hardness within a first hardness range, the shaft having a radial area that bears against the tube via the link part, the link part being positioned between the tube and the shaft and being made from a flexible material presenting a second hardness lower than the first hardness range so as to absorb vibrations, the shaft having a free terminal area that is not covered by the link part, and that is radially separated from the tube so as to be able to vibrate freely in an internal volume of the tube, and an air volume filling the entire internal volume of the tube in which the shaft freely vibrates.

* * * * *